US006513809B1

(12) United States Patent
Graff

(10) Patent No.: US 6,513,809 B1
(45) Date of Patent: Feb. 4, 2003

(54) CHESS PIECES AND CHESS SETS

(76) Inventor: Milton Brayton Graff, 229 W. Hill La., Wyoming, OH (US) 45215

( * ) Notice: Subject to any disclaimer, the term of this patent is extended or adjusted under 35 U.S.C. 154(b) by 0 days.

(21) Appl. No.: 09/626,236

(22) Filed: Jul. 26, 2000

(51) Int. Cl.[7] ..... A63F 3/00
(52) U.S. Cl. ..... 273/288; 273/260
(58) Field of Search ..... 273/260, 288, 273/236

(56) References Cited

U.S. PATENT DOCUMENTS 1,208,620 A * 12/1916 Moser
D219,037 S * 10/1970 Laufer
4,531,739 A * 7/1985 Dunn

* cited by examiner

*Primary Examiner*—Benjamin H. Layno
*Assistant Examiner*—V K Mendiratta
(74) *Attorney, Agent, or Firm*—Milton B. Graff

(57) ABSTRACT

The subject invention involves chess pieces made primarily from hardware components and chess sets of such chess pieces. Each chess piece comprises a center shaft component comprising a vertical threaded rod having a bottom end, a top end, and a surface from the rod's bottom end to its top end that is partially or wholly cylindrical and threaded. The center shaft component optionally comprises a head at either its bottom or top end. Each chess piece also comprises holed components, each holed component having a hole through which or into which the center shaft component projects. The holed components are stacked along the length of the center shaft component. All the holed components are secured in place by one or more holed components which are nuts having threads complementary to those of the threaded rod, and optionally by the head of the center shaft component.

26 Claims, 5 Drawing Sheets

Fig. 1
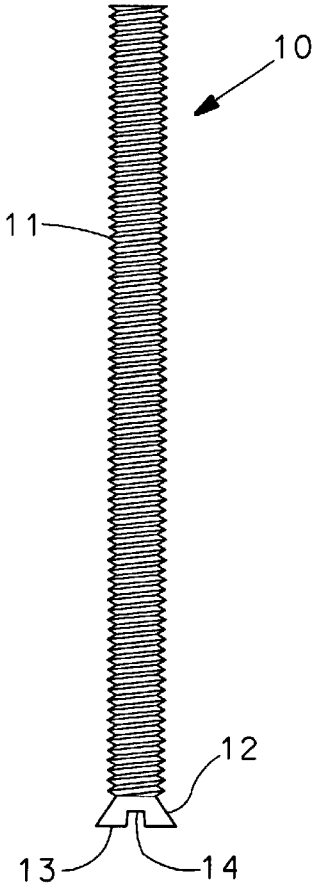
Fig. 4A
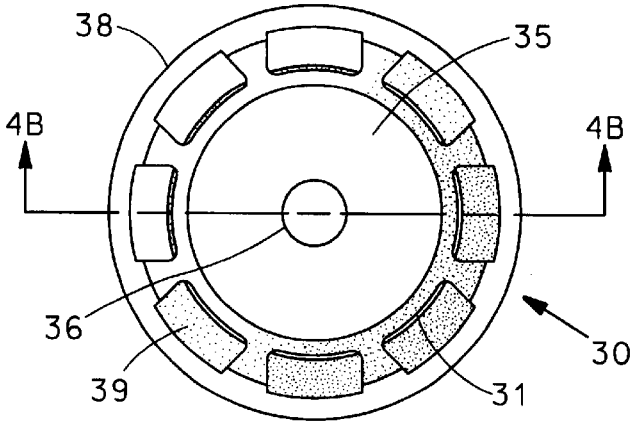
Fig. 4B
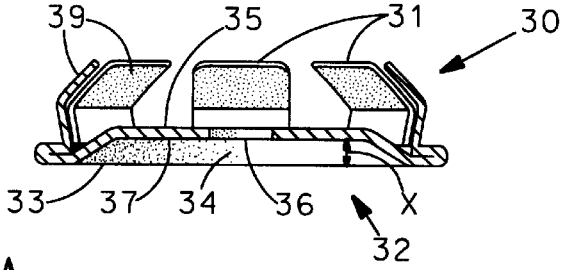
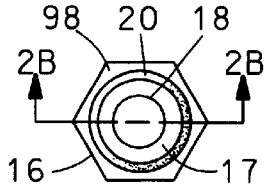
Fig. 2A
Fig. 4C
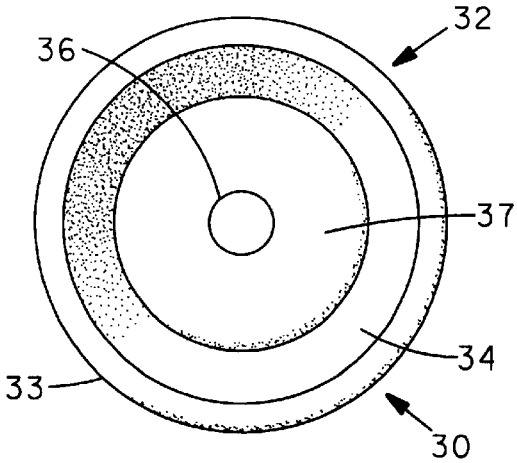
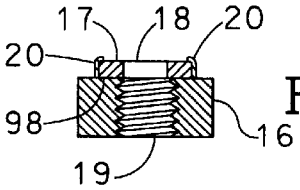
Fig. 2B
Fig. 3
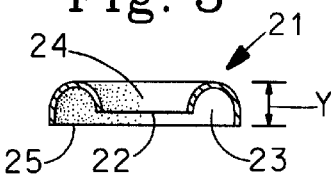

CHESS PIECES AND CHESS SETS

TECHNICAL FIELD

The subject invention involves chess pieces comprising hardware components, and chess sets of such chess pieces.

OBJECTS OF THE INVENTION

It is an object of the subject invention to provide chess pieces and chess sets of unique appearance.

It is a further object of the subject invention to provide chess pieces having a desirable feel or weight, preferably having a large portion of their weight near the bottom of each chess piece.

SUMMARY OF THE INVENTION

The subject invention includes chess pieces and chess sets; each chess piece comprises, preferably consists of: (a) a center shaft component having a bottom end and a top end and a length from its bottom end to its top end; the center shaft component comprising a vertical threaded rod having a bottom end, a top end, and a surface from the rod's bottom end to its top end that is partially or wholly cylindrical and threaded; the center shaft component optionally comprising a head at either its bottom or top end; and (b) holed components, each holed component having a hole through which or into which the center shaft component projects, the holed components being stacked along the length of the center shaft component, all the holed components being secured in place by one or more holed components which are nuts having threads complementary to those of the threaded rod, and optionally by the head of the center shaft component.

BRIEF DESCRIPTION OF THE DRAWINGS

FIG. 1 is a side view of a flat head machine screw.

FIG. 2A is a top view and FIG. 2B is a cutaway side view of a lock nut.

FIG. 3 is a cutaway side view of a finish washer.

FIG. 4A is a top view, FIG. 4B is a cutaway side view, and FIG. 4C is a bottom view of a knockout seal.

DETAILED DESCRIPTION OF THE INVENTION

Figure 5:
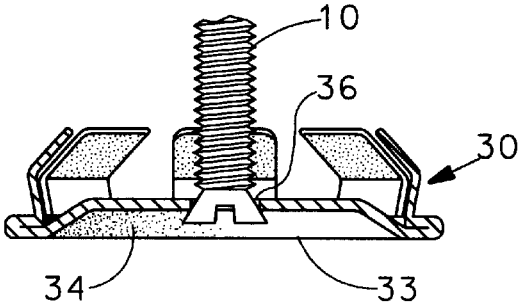
FIGS. 5, 6, 7 and 10 are cutaway side views

The subject invention includes certain chess pieces and chess sets, each set comprising two identifiable teams of sixteen such chess pieces each: eight pawns, two rooks, two knights, two bishops, one queen, and one king. A subject invention chess piece is made from components. As used herein, "component" means an individual piece of a material or article of manufacture. As used herein, a "holed component" is a component comprising a hole completely or partway through it. Such components are generally used for purposes other than making chess pieces.

Preferred chess pieces of the subject invention are made primarily from hardware components. As used herein, "hardware component" means any small individual article of manufacture typically sold in a hardware store. Non-limiting examples of hardware components include nuts, washers, bolts (including machine screws), pieces and fittings of tubing and pipe, wall anchors, and knockout seals. There are large varieties of types and sizes of such hardware components. Preferred hardware components are primarily made of metal, but may be made wholly or partly of plastic or other materials. Metal hardware components are made of steel, steel coated with zinc or nickel or other metal or material, stainless steel, brass, bronze, copper, and other metals. Plastic hardware components are made of nylon, polyethylene, polypropylene, and other polymers and copolymers.

As used herein, "primarily from hardware components" means that most of the components of a subject chess piece are hardware components. Preferably at least about 70% of the different types of components of which a subject chess piece is made are hardware components. More preferably, a subject chess piece comprises no more than two types of components that are other than hardware components; more preferably still, no more than one type of component other than hardware components. (However, such preferred chess pieces may comprise several—three, four, five, or more—of the same type of non-hardware component and still fall within the restrictions of this paragraph.)

For the subject invention chess pieces, absolute precision of dimensions, directions, shapes, quantities, and the like, is not generally required; approximation is good enough. Therefore, words used herein that reflect such properties are to be construed as meaning that the stated description is substantially or approximately required. Non-limiting examples of words used herein that should be understood to have such approximate meanings include: parallel, perpendicular, center, entire, circle, circular, flat, straight, uniform, equal, horizontal, vertical, cylindrical, regular hexagonal, and the like. It is preferred that the components or combinations of components described as having such properties approach or are close to such descriptions. In other words, minor differences from such described properties are readily tolerated.

As used herein, a subject invention chess piece is "upright" when it is in its intended orientation for playing a game of chess on a flat horizontal surface.

A subject invention chess piece comprises, preferably consists of, a center shaft component and holed components.

A subject invention chess piece has a vertical center shaft component having a bottom end and a top end and a length from the bottom end to the top end of the center shaft component. The center shaft component optionally comprises a head at one end, and comprises a straight rod, more preferably a straight cylindrical rod having a circular cross-section, from the head to the other end, or, if there is no head, from one end to the other end of the center shaft component. The center shaft component preferably has a head either at the bottom end or at the top end, more preferably at the bottom end. As used herein, the "depth" of the head of the center shaft component is its maximum dimension in the direction of the length of the center shaft component. As used herein, the "length" of the rod coincides with the length of the center shaft component, less the depth of the head if there is a head. As used herein, the "width" of the head or of the rod of the center shaft component is that part's maximum dimension in any direction perpendicular to the length of the center shaft component; the width of the head is greater than the width of the rod. At least part of the rod, preferably all of it, has a cylindrical outer surface along its length. The cylindrical part of the rod is preferably uniform in diameter along its entire length. At least part of the cylindrical surface of the rod, preferably all of it, is threaded (has a thread spiraling around the cylindrical surface); the threaded part preferably has a thread of uniform size and spacing along the length of the rod.

For a subject invention chess piece, a preferred center shaft component is a bolt. As used herein, a "bolt" comprises a rod having two ends and a length between the ends, and a head at one end of the rod. For a subject chess piece, the bolt is oriented with the length of the rod vertical when the chess piece is upright, such that the rod and the bolt each have a bottom end and a top end. The head of the bolt can be either at its bottom end or at its top end; it is preferably at the bottom end of the bolt. The rod has a circular cross section (perpendicular to its length) of uniform diameter from one end to the other, such that the outer surface along the length of the rod is cylindrical. At least a portion of the outer cylindrical surface along the length of the rod is threaded; preferably all of such outer surface is threaded, preferably with thread of uniform size and spacing. The width of the head is, preferably in all directions perpendicular to the length of the rod, wider than the diameter of the rod. Common types of bolts available in hardware stores have rods of uniform diameter and often are threaded along the entire length of the rod from where the head meets one end of the rod to its other end. Such bolts are available with heads of different shape perpendicular to the length of the rod; non-limiting examples are square heads, hexagonal heads, and circular heads, which include flat heads and round heads and pan heads.

As used herein, "machine screw" means a bolt having a cylindrical rod of uniform diameter, preferably threaded along its entire length; and having a head of circular cross-section with its end away from the rod being engageable with a screwdriver, preferable with a flat or Phillips screwdriver. Machine screws are preferred center shaft components for the subject chess pieces because their heads are generally small in depth. Most preferred as center shaft components for subject chess pieces are flat head machine screws. The flat surface end of the head has a slot or indent in it where a flat or Phillips screwdriver can be engaged. A flat head machine screw 10 is depicted in side view in FIG. 1. It has threaded rod 11 with threads along its entire length, and head 12 which is circular in cross section perpendicular to the length of rod 11; head 12 gradually increases in diameter from where head 12 meets rod 11 to flat surface 13 of head 12 on its end away from rod 11. Head 12 has slot 14 in flat surface 13 for engaging the end of a flat screwdriver.

Because they are convenient sizes for use as center shaft components for subject invention chess pieces, preferred machine screws include those designated: 4-32, 6-32, 8-32, 10-32, and 10-24. The first number in each designation is an indication of the diameter of the threaded rod, the outer diameter (including threads) of a no. "4" being about 2 mm, of a no. "6" being about 3 mm, of a no. "8" being about 4 mm, and of a no. "10" being about 5 mm. The second number in each designation is the number of threads per inch (25.4 mm) along the length of the threaded rod. Most preferred machine screws useful as center shaft components of subject chess pieces, due to their sizes, are 6-32 and 8-32 machine screws. Such machine screws are available in hardware stores in many lengths from one inch (25 mm) or less to four inches (102 mm) or more. The length used depends on the height of the chess piece desired; any height desired can be achieved by cutting an overlong machine screw to the desired length.

The subject invention chess pieces comprise holed components, each holed component having a hole through which or into which the center shaft component projects. A holed component may have more than one hole; but as used herein, any reference to a "hole" of a holed component refers to the hole through or into which the center shaft component projects, unless a different hole is specifically described. The holed components are stacked along the length of the vertical center shaft component, each holed component having a lower surface and an upper surface. The upper surface of a holed component is often in contact with the lower surface of the holed component adjacent to and above it, but such contact is not always necessary. As used herein, the "bottom holed component" for each subject chess piece is the lowermost holed component along the center shaft component of the chess piece, and the "top holed component" is the uppermost holed component along the center shaft component. (Note that a holed component may be shaped such that part of it extends lower than the lowest part of one or more holed components that are below it at the center shaft component, or vice versa.) The remaining holed components are between the bottom and top holed components at their holes through which the center shaft component projects. The center shaft component projects entirely through the hole of every holed component of a subject chess piece, with the possible exceptions of the top and/or the bottom holed components. At either end of the center shaft component where there is no head, the center shaft component alternatively projects either into or entirely through the hole of the holed component that is at that end (top or bottom).

For many preferred holed components of the subject invention chess pieces, the perimeters of their upper and lower surfaces are regular geometric shapes. For preferred holed components of a subject chess piece, such perimeters define (or lie in) planes that are perpendicular to the length of the center shaft component of the chess piece. As used herein, "regular geometric shape" means (1) a straight-sided geometric shape wherein all sides and angles are equal, such as an equilateral triangle, a square, a regular pentagon, a regular hexagon, a regular octagon, etc.; or (2) a bilaterally symmetrical curved shape, such as a circle, an ellipse, etc. The most preferred geometric shapes of the upper and lower surfaces of the holed components are regular hexagonal and circular. As used herein, the "geometric center" of a regular geometric shape is the point at which lines that bisect its surface area meet. As used herein, the "diameter" of a regular geometric shape is the longest line that bisects its surface area. For many preferred holed components, their lower and upper surfaces are parallel; if flat, these surfaces define or lie in parallel planes.

Preferred holed components of subject chess pieces include, but are not limited to, nuts, washers, and knockout seals.

As used herein, a "nut" is any hardware component having a threaded cylindrical hole that can be screwed onto a bolt having complementary threads. As used herein, a bolt and a nut have "complementary" threads if their threads properly enmesh as the nut is screwed onto the bolt (or the bolt is screwed into the nut) so that the nut stays securely on the bolt at whatever position it is screwed to, unless the nut or bolt is rotated in order to reposition the nut on the bolt or to take the nut off the bolt. Nuts are typically designated according to the size of bolt onto which they are designed to screw securely; therefore, for examples, a 6-32 nut has threads in its hole that are complementary to those on the threaded rod portion of a 6-32 machine screw; threads of an 8-32 nut are complementary to those of an 8-32 machine screw; etc. At least some of the nuts that are components of a subject invention chess piece must have threads which are complementary to those of the threaded rod of the center shaft component of the chess piece, because such nuts are required to secure holed components in place along the center shaft component. Unless stated otherwise herein, any nut that is described as being part of a subject chess piece has threads complementary to those of the center shaft component of the chess piece.

For the subject invention chess pieces, two types of nuts preferred for use in securing components in place along the length of the center shaft component are standard nuts and lock nuts.

As used herein, a "standard nut" is a hardware component that is typically called a "nut" (with no prefix) in a hardware store; it typically has a square or regular hexagonal perimeter, a lower surface and an upper surface which are typically parallel to one another and equal in surface area, the distance between the lower and upper surfaces being the thickness of the nut, and a threaded cylindrical hole from the lower surface to the upper surface through their geometric centers, the interior cylindrical surface of the hole being perpendicular to the lower and upper surfaces. Preferred standard nuts are made entirely of metal, but standard nuts made of plastic can also be holed components.

As used herein, a "lock nut" (sometimes called a "stop nut") is a hardware component that looks much like a metal standard nut with a piece of plastic against either the upper or lower surface. A typical lock nut 15 is shown enlarged in top view in FIG. 2A and cutaway side view in FIG. 2B. Hexagonal metal nut part 16 has plastic piece 17 against its upper surface 98. Plastic piece 17 typically has cylindrical unthreaded hole 18 through it aligned with threaded hole 19 of metal part 16, the cylindrical interior surface of hole 18 in plastic piece 17 being about aligned with the tops of the threads of hole 19 in metal part 16. Plastic piece 17 is partly covered and secured in place by metal casing 20 which extends from upper surface 98 of metal part 16; casing 20 curves around the edge of plastic piece 17, thus holding it next to upper surface 98 of metal part 16. This results in a profile seen in the side view which tapers toward the surface of the lock nut where the plastic piece is located; such tapered shape is a useful property for purposes described hereinafter. When screwed into the hole of a lock nut, the threads of a bolt with threads complementary to those of the metal hole of the lock nut will cut into the interior cylindrical surface of the hole in the plastic piece. Friction, between the plastic piece and the threads of the bolt screwed into it, causes a lock nut to be more securely stopped in place on a threaded rod having complementary threads than is a standard nut; it generally takes more force to rotate a lock nut on a rod with complementary threads than to rotate a standard nut on such rod. For the subject chess pieces, the greater securing benefit of lock nuts often makes them preferable to standard nuts; however, lock nuts are typically thicker (distance between the lower and upper surfaces) than standard nuts and don't always fit as desired. The tapered shape of a lock nut makes it preferred for some purposes.

As used herein, a "washer" is a hardware component having a regular geometric shaped lower surface and upper surface, a hole from the lower surface to the upper surface at their geometric centers, the distance between the lowermost part of the lower surface and the uppermost part of the upper surface being the thickness of the washer. The lower and upper surfaces of a washer are preferably parallel; the perimeter of these surfaces is preferably a square, a regular hexagon, or a circle, most preferably a circle. The hole can be a variety of shapes, but is large enough for the center shaft component to project entirely through it; the shape of the hole perpendicular to the thickness of the washer is preferably circular. The maximum distance across the lower or upper surface bisecting the hole is the diameter of a washer. The thickness of a washer is small compared to its diameter; preferably the ratio of thickness to diameter for a washer is from about 1:15 to about 1:3.

Three types of washers are preferred components of subject invention chess pieces: standard washers, fender washers, and finish washers.

As used herein, a "standard washer" or "flat washer" is a washer having a flat lower surface, a flat upper surface, and a hole at the geometric center of these surfaces from the lower surface to the upper surface. The lower and upper surfaces preferably define (or lie in) parallel planes, the thickness of the washer being uniform and the distance between these planes. Preferred standard washers have circular lower and upper surfaces of the same diameter (the "outer" diameter of the washer) and a circular hole at the center of them; the diameter of the hole is from about one-third to about one-half the outer diameter of the washer. Standard washers are typically named according to the size of bolt on which they are designed to be used: e.g., a no. 8 washer on a no. 8 machine screw (e.g., an 8-32 machine screw), a ¼ inch washer on a ¼ inch bolt, etc.

As used herein, a "fender washer" is similar to a standard washer; it has flat, parallel, circular upper and lower surfaces and a circular hole through their centers. But the hole diameter is smaller for a fender washer than for a standard washer of the same outer diameter; preferably the diameter of the hole of a fender washer is from about one-eighth to about one-fourth the outer diameter of the washer. Fender washers are typically named according to their hole diameter and their outer diameter: e.g., a ⅛×¾ fender washer has a ¾ inch (19 mm) outer diameter and a ⅛ inch (3 mm) diameter hole, a 3⁄16×1¼ fender washer has a 1¼ inch (32 mm) outer diameter and a 3⁄16 inch (5 mm) diameter hole, etc.

As used herein, a "finish washer" (sometimes called a "finishing washer") is similar to a standard washer except that the lower and upper surfaces are not flat. FIG. 3 depicts an enlarged cutaway side view of typical circular finish washer 21 having circular hole 22 at the geometric centers of lower surface 23 and upper surface 24. Lower surface 23 and upper surface 24 are preferably parallel, lower surface 23 being concave and upper surface 24 convex (or reversed if the washer is inverted from the orientation shown in FIG. 3). When oriented as shown in FIG. 3 on a horizontal flat surface, preferably only outer rim 25 of lower surface 23 is in contact with the horizontal flat surface. The thickness of finish washer 21 is Y, the distance from the lowermost part of lower surface 23 (outer rim 25) to the uppermost part of upper surface 24.

As used herein, a "knockout seal" is a hardware component commonly used to snap into and plug a hole in an electrical box. A knockout seal comprises a disc having two circular surfaces; one of the surfaces has an outer rim that defines (lies in) a plane. Prongs project from the other surface of the disc about perpendicular to the plane of the outer rim; the prongs have ends that are the edges furthest from and parallel to the disc surface from which the prongs project; these ends of the prongs define a plane parallel to the plane of the outer rim. There is a hole through the disc from the center of one circular surface to the center of the other.

An enlarged exemplary knockout seal 30 is depicted in top view in FIG. 4A, cutaway side view in FIG. 4B, and bottom view in FIG. 4C. It comprises indented disc 32 having lower surface 34 and upper surface 35, and circular rim 33 as perimeter of lower surface 34. Circular rim 33 defines (or lies in) a plane. As used herein, the "outer rim" of a knockout seal corresponds to rim 33 of knockout seal 30 as depicted in FIGS. 4B and 4C. Indented part 37 of disc 32 is indented from the plane of circular rim 33. Hole 36 is at the center of disc 32 from lower surface 34 to upper surface 35. Disc 32 has an indent depth X that is the distance between the plane of circular rim 33 and lower surface 34 at hole 36. While knockout seals obtained from a hardware store usually do not have hole 36 at the center of disc 32, such hole of desired size is readily achieved by drilling, punching, or other means.

Knockout seal 30 has upper surface 35 having circular rim 38 as its perimeter; rim 38 has the same diameter as rim 33 of lower surface 34, the two rims being separated by the small thickness of disc 32 at its outer edge. Prongs 39 project from upper surface 35 near circular rim 38, preferably a small distance toward the center of the disc from rim 38. Prongs 39 project generally upward from upper surface 35 when knockout seal 30 is at rest on a flat horizontal surface on rim 33 in a direction about perpendicular to such horizontal surface. Ends 31 of prongs 39 are the edges of prongs 39 which are furthest from upper surface 35; ends 31 define (or lie in) a circle that defines (or lies in) a plane, which is parallel to the plane of circular rim 33. The upper part of prongs 39 are preferably somewhat bent toward the center of the circle defined by their upper edges, as depicted in FIG. 4B.

The foregoing description is of a knockout seal oriented as shown in FIG. 45. Such knockout seal can readily be inverted, reversing the lower and upper surfaces and having prongs 39 projecting generally downward. Either orientation is useful for different subject invention chess pieces, the orientation shown in FIG. 4B being more preferred.

Knockout seals are commonly available in hardware stores in various sizes to fit as plugs of holes of common electrical boxes. The three most common sizes are nominally designated "one-half inch", "three-quarter inch", and "one inch" knockout seals; these typically have outer rim diameters of about 27 mm, 31 mm, and 37 mm, respectively. For all three common sizes, the prongs are about 7 mm wide and about 7 mm high; a one-half inch knockout seal typically has six prongs, and three-quarter inch and one inch knockout seals each typically have eight prongs, all evenly spaced around the edge of upper surface 35 and inset about 1½ mm from rim 38. Each knockout seal is typically made from one piece of sheet metal that is about 0.7–1 mm in thickness. Most of indented disc 32 is one thickness of the sheet metal; all around the outer perimeter of the disc, the sheet metal is rolled over to create a second thickness for the about 1½ mm from circular rim 38 to where the projections of the upper layer of sheet metal are bent upward from the edge of the top thickness of metal forming prongs 39.

As used herein, the "base" of a subject invention chess piece is the part on which the chess piece rests when the chess piece is upright on a flat horizontal surface; the base defines (or lies in) a plane. The top on the chess piece is its uppermost part when it is upright. The height of the chess piece is the shortest distance from the plane of the base to the top of the chess piece. It is desirable that the base be relatively wide (in all directions perpendicular to the height of the chess piece) so that the chess piece has good stability when upright. For a subject chess piece, the ratio of the height of the chess piece to the width of its base (diameter, if the base is circular, as is preferred) is preferably from about 4:1 to about 1:1, more preferably from about 2.5:1 to about 1.5:1. Although it is possible to align parts of two components such that together they are the base of a subject chess piece, it is preferred that the base be part of just one component.

In a preferred aspect of a subject invention chess piece, the center shaft component has a head on its bottom end, and the base of the chess piece is part of the lower surface of its bottom holed component. The lower surface of such bottom holed component comprises: (a) a center part including the hole through which the center shaft component projects which is above at least part of the head of the center shaft component, and (b) a part which is the base of the chess piece which is below the bottom of the head of the center shaft component.

Figure 6:
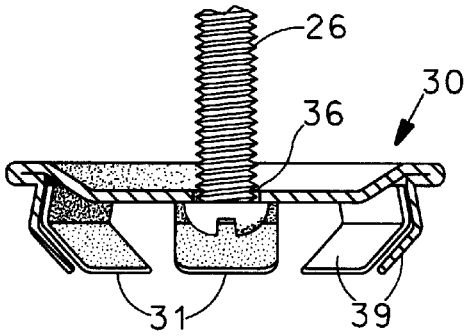

A preferred example of such a chess piece comprises: a bolt as the center shaft component, more preferably a machine screw, more preferably still a flat head machine screw; a knockout seal; and other holed components. FIG. 5 depicts a cutaway side view of the base portion of such an example: truncated flat head machine screw 10 projects through hole 36 of knockout seal 30 which is the bottom holed component; rim 33 of lower surface 34 of knockout seal 30 is the base of a subject chess piece comprising such base portion. FIG. 6 depicts a cutaway side view of the base portion of another such example: truncated round head machine screw 26 projects through hole 36 of knockout seal 30 which is the bottom holed component, but is in inverted orientation compared to the knockout seal depicted in FIG. 5; ends 31 of prongs 39 are the base of a subject chess piece comprising such base portion.

Figure 7:
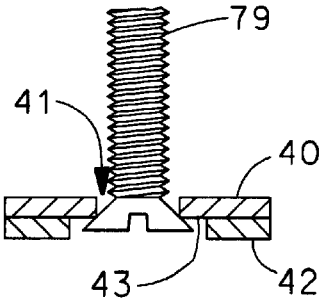

Another example of such a chess piece comprises a bolt as the center shaft component, more preferably a machine screw, more preferably still a flat head machine screw, and a fender washer as the bottom holed component, the fender washer having padding attached to the outer part of its lower surface, the lower surface of the padding being below the bottom of the head of the bolt. FIG. 7 depicts a cutaway side view of a base portion of such example: truncated flat head machine screw 79 projects through hole 41 in fender washer 40 with thick padding 42 adhesively attached to lower surface 43 of fender washer 40. Suitable padding materials for thick padding 42 include, but are not limited to, cork, felt and other fabrics, styrofoam and other plastics, etc.

Figure 8:
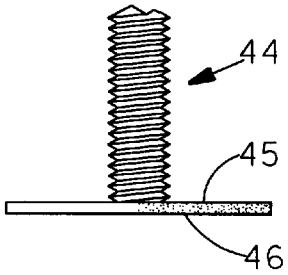
FIGS. 8 and 9 are side views of different base portions of subject chess pieces.

In another aspect, a subject invention chess piece comprises a bolt for a center shaft, the bolt having a head on the bottom end of its threaded rod, the head of the bolt having a large flat or indented lower surface. The base of such chess piece is the lower surface of the head if it is flat or the outer rim of such lower surface if it is indented. Holed components are stacked along the length of the threaded rod of such bolt above its head. FIG. 8 depicts a side view of truncated bolt 44 having flat circular head 45; circular flat lower surface 46 of head 45 of bolt 44 can be the base of a subject invention chess piece.

In another aspect, a subject invention chess piece comprises a threaded rod with no head on either end, or a bolt with a head on the top end of its threaded rod. Such chess piece has a nut for its bottom holed component and other holed components stacked along the length of the threaded rod above the bottom nut. The base of such chess piece is a part of, or the entire, lower surface of the bottom nut or a part of another holed component that extends below the lower surface of the bottom nut.

Figure 9:
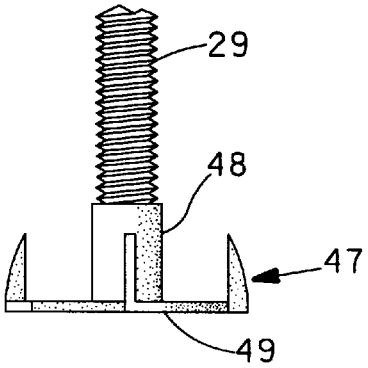

For such chess piece having a part or all of the lower surface of the bottom nut as its base, a bottom nut having a broad, flat or indented lower surface is preferred, for example, a T-nut. FIG. 9 depicts a side view of T-nut 47 with truncated complementary threaded rod 29 screwed into cylindrical shaft 48 that has a threaded hole through it; flat lower surface 49 can be the base of a subject chess piece.

Figure 10:
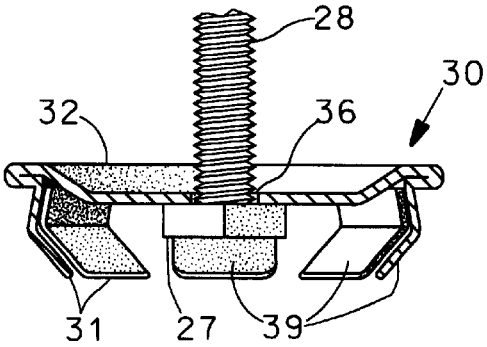

An example of such a chess piece for which the base is a part of a holed component that extends below the lower surface of the bottom nut is depicted in cutaway side view in FIG. 10. Knockout seal 30 is oriented such that prongs 39 project downward such that hole 36 in disc 32 is above bottom standard nut 27 which is screwed onto the bottom of truncated threaded rod 28. Ends 31 of prongs 39 are below the lower surface of nut 27 and can be the base of a subject chess piece.

A preferred subject invention chess piece comprises a lower portion and an upper portion. The lower portion includes the base of the chess piece. For chess pieces of one chess set of the subject invention, the lower portions are preferably made from the same types of components and constructed in a similar manner so that they look similar, although they may differ in size, the lower portions of pawns preferably being smaller than those of rooks, knights, and bishops, which are preferably smaller than those of queens and kings. The upper portion of different chess pieces which make up a chess set include one or more components which provide each chess piece with an identifiable shape as a pawn, rook, knight, bishop, queen, or king.

A subject invention chess set comprises, preferably consists of, two teams: the teams are typically differentiated by color. One way to differentiate the teams is to paint all the chess pieces of a team the same color, and each team a different color. However, preferred subject chess pieces are not entirely painted. Preferably, at most one type of holed component of each chess piece of a team is painted a team-identifying color; more preferably no components are painted.

For particularly preferred chess pieces and chess sets of the subject invention, the lower portion of each chess piece comprises one or more components, preferably holed components, of a certain color which identifies the team to which each chess piece belongs.

Preferred colored holed components useful for subject chess pieces include hardware components including, but not limited to, plastic and metal wall anchors, plastic and metal pieces of tubing and piping, plastic and metal tubing and piping fittings, and other tubular hardware components. Such hardware colored holed components are sometimes available in two or more colors for use as components of chess pieces for different teams of a chess set; alternatively, such components can be painted different colors to distinguish chess pieces of different teams. Such components are often available in different widths and can often be cut to desired lengths, so that different widths and/or lengths can be used for different size chess pieces.

Especially preferred colored holed components are craft beads that are readily available in a large variety of colors. Preferred craft beads are about 9 mm in diameter, about 6 mm long, and have a hole about 4 mm in diameter, the hole being parallel to such length through the center of the bead. The threaded rod of an 8-32 machine screw fits snugly in the hole of such a bead. The threaded rod of a smaller machine screw, e.g. 6-32, can be made to fit snugly in the hole of such a bead by wrapping a small piece of tape, e.g. electrical or friction tape, around the threaded rod.

Figure 11:
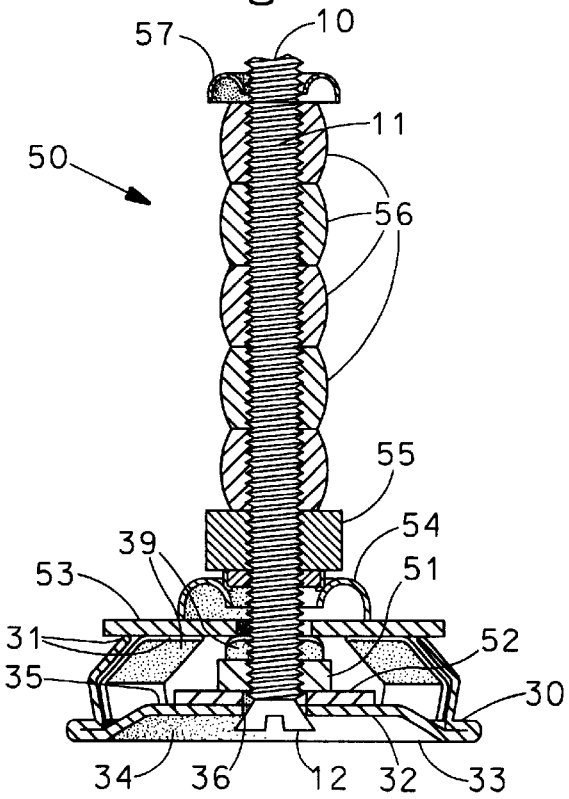
FIG. 11 is a cutaway side view of a preferred lower portion of a subject piece.

FIG. 11 depicts a cross-sectional view of preferred lower portion 50 of a subject invention chess piece. Rim 33 of lower surface 34 of indented disc 32 of knockout seal 30 is the base of a chess piece comprising lower portion 50. Truncated threaded rod 11 of flat head machine screw 10 projects upward through hole 36 in the center of knockout seal 30, in a direction perpendicular to the plane of rim 33. Part of head 12 of machine screw 10 is below lower surface 34 at hole 36, since the width of head 12 is larger than the diameter of hole 36, but all of head 12 is above the plane of rim 33. Machine screw 10 has threads along the entire length of rod 11, and is secured in position by standard nut 51. Standard washer 52 is needed between nut 51 and upper surface 35 of knockout seal 30, if part of head 12 of machine screw 10 projects above upper surface 35 (the hole of washer 52 being of greater diameter than any part of head 12 which projects above surface 35); this may be necessary to assure that all of head 12 is above the plane of outer rim 33.

Fender washer 53 has a diameter slightly greater than that of the circle defined by ends 31 of prongs 39 of knockout seal 30, such that parts of the lower surface of fender washer 53 are in contact with ends 31 of prongs 39. The lower rim of finish washer 54 is in contact with part of the upper surface of fender washer 53. Threaded rod 11 projects through the holes of fender washer 53, finish washer 54, and lock nut 55. Lock nut 55 secures fender washer 53 and finish washer 54 in place. Preferably, part of the tapered surface of lock nut 55 is in contact with part of the upper surface of finish washer 54. Four colored beads 56 are stacked above lock nut 55, and finish washer 57 is above the top bead, part of the lower surface of each of these holed components being in contact with part of the upper surface of the holed component immediately below it.

The upper portion of a preferred subject invention chess piece identifies the chess piece as a pawn, rook, knight, bishop, queen or king. Certain holed components and combinations of holed components provide preferred appearances for upper portions and parts of upper portions of subject chess pieces. Nuts which are preferred upper portion holed components include cap nuts, slotted hex nuts, castle nuts, toggle nuts, T-nuts, and wing nuts.

A cap nut (sometimes called an acorn nut) is a preferred upper portion holed component. Because the hole in a cap nut goes only part way through the cap nut, it is the top holed component along the length of the threaded rod whenever it is present as part of an upper portion of a subject chess piece. Cap nuts can be used as the top holed component for any subject chess piece; it is particularly preferred as the top holed component for pawns and bishops. Such cap nut is screwed onto the threaded rod of the center shaft of the chess piece to secure itself, and preferably holed components below it, in place along the center shaft component.

Figure 12:
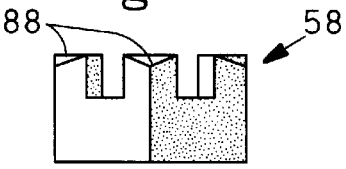
FIGS. 12 and 13 are side views of a slotted hex nut and a castle nut, respectively.
Figure 13:
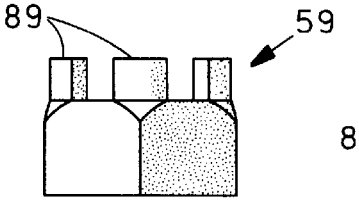

Slotted hex nut 58 is depicted in side view in FIG. 12; castle nut 59 is depicted in side view in FIG. 13; both have prongs, 88 and 89, respectively, pointing upward; both are preferred upper portion holed components. A slotted hex nut or castle nut may have threads complementary to those of the threaded rod of the center shaft component of the chess piece. More preferred is for a slotted hex nut or a castle nut to have a hole larger in diameter than the diameter of the threaded rod of the center shaft component; such slotted hex nut or castle nut is preferably of such size that a standard nut or a lock nut, having threads complementary to those of the threaded rod of the center shaft component, nests inside prongs 88 or 89 of slotted hex nut 58 or castle nut 59, respectively, but will not pass through the hole of the slotted hex nut or castle nut, such that the two nuts will only rotate together, when such standard nut or lock nut is screwed onto a threaded rod. An example of such a configuration is depicted in top view in FIG. 14A and cutaway side view in FIG. 14B; upper portion or part of upper portion 60 comprises slotted hex nut 58 with standard nut 61 nested inside prongs 88. Lock nut 63 is immediately below slotted hex nut 58 such that part of its tapered upper surface is in contact with part of the lower surface of slotted hex nut 58 and part of lock nut 63 projects partially into the hole of slotted hex nut 58. Both standard nut 61 and lock nut 63 have threads complementary to those of threaded rod 11, whereby slotted hex nut 58 is held securely in place by rotating standard nut 61 and lock nut 63 in opposite directions (or by rotating one and keeping the other in place) on threaded rod 11 until slotted hex nut 58 is held tightly between them at the desired position along threaded rod 11. Such a configuration also works well to hold a castle nut at a desired position on a threaded rod.

A slotted hex nut is a preferred upper portion holed component for a rook, a queen, or a king; more preferred for a rook. A castle nut is a preferred upper portion holed component for a rook, a queen, or a king; more preferred for a queen.

A toggle nut is a preferred upper portion holed component for a knight. A toggle nut has a part with a threaded hole, such part being attached to two hinged wings. A preferred orientation for a toggle nut used as part of a subject knight chess piece is depicted in side view in FIG. 15: hinged wings 66 and 67 of toggle nut 65 are held together and threaded hole part 68 is screwed onto threaded rod 11 such that threaded rod 11 holds wings 66 and 67 together in the closed position shown, whereby toggle nut 65 appears somewhat like the snout of a horse. It is sometimes necessary to file or cut a bit of metal from the end of one or both wings near holed part 68 of toggle nut 65 in order to be able to screw it onto threaded rod 11 and have the threaded rod hold the hinged wings together.

A T-nut is a preferred holed component for upper (or lower) portions of subject chess pieces. A typical T-nut has a circular flat disc with two circular surfaces, a short cylindrical shaft projecting from the center of one circular surface of the disc, the length of the shaft being perpendicular to such disc surface from such disc surface to the circular end of the shaft, a threaded hole through the center of the disc and the shaft, and three or four sharp points projecting from near the outer rim of the same disc surface as the cylindrical shaft and pointing in a direction parallel to the length of the shaft, the points being about one-half to three-fourths the length of the shaft. As a part of the depiction of FIG. 16, finish washer 76 is oriented concave side up to contact and cover the sharp points of T-nut 75; cylindrical shaft 74 of T-nut 75 projects through the hole of finish washer 76. T-nut 75 has threads complementary to and is screwed onto threaded rod 11. This T-nut/finish washer combination is a preferred combination in the orientation shown in FIG. 16, or the reverse orientation, (with or without any or all of the other holed components depicted in FIG. 16) as a part of either lower portions or upper portions of subject chess pieces.

A wing nut is a preferred holed component for upper portions of subject chess pieces. It is particularly preferred as the top holed component for a king or a queen, especially a king.

Following is a description of particularly preferred subject invention chess pieces, specific components used to make them, and a preferred method of assembling the components. The six different chess pieces that are needed for a chess set are described.

A flat head machine screw with its head down is the center shaft component for all six different chess pieces. Holed components are placed on or screwed onto the machine screw in order from the bottom up. As each nut with threads complementary to those of the machine screw is screwed on, the nut is screwed onto the machine screw as far as it will go and tightened against the holed component immediately below it on the machine screw. This secures, in place on the machine screw, all holed components without threads complementary to the machine screw, between such nut and the next previous nut with threads complementary to those of the machine screw.

All six different chess pieces comprise a lower portion that is quite similar to lower portion 50 depicted in FIG. 11; the sizes of some components are varied to achieve different size chess pieces, and the number of colored beads used is varied to help achieve different heights of chess pieces. Also, where one standard washer 52 is depicted, it is often preferable to use two standard washers to secure knockout seal 30 on machine screw 10; a larger washer below, with a hole large enough to straddle the part of head 12 of machine screw 10 that projects through hole 36 of knockout seal 30, and a smaller washer above.

For each of the six different chess pieces, machine screw 10 of desired length is selected; if one of the length desired is not available, a longer one is cut to the desired length. Hole 36 is drilled in the center of knockout seal 30; the size of the hole is smaller than the width of head 12 of machine screw 10, but large enough that head 12 is entirely above the plane of rim 33 when positioned as shown in FIG. 11. Machine screw 10 is placed through hole 36 of knockout seal 30 with the slotted surface of head 12 below lower surface 35 of knockout seal 30 and with prongs 39 of knockout seal 30 pointing up. Standard washer 52 (or two of them as described above) is placed on threaded rod 11 and in contact with upper surface 35 of knockout seal 30. Standard nut 51 is screwed onto threaded rod 11 and tightened to secure washer 52 and knockout seal 30 in place. Fender washer 53 is placed on threaded rod 11 so that it is in contact with and centered on ends 31 of prongs 39 of knockout seal 30; each of prongs 39 can be bent slightly toward or away from threaded rod 11 if needed to achieve a desired fit of fender washer 53 on ends 31. Washer 52 (or the two washers used) and nut 51 are thin enough to permit fender washer 53 to rest flat against ends 31 of all of prongs 39. Finish washer 54 is placed on threaded rod 11 so that its concave side is in contact with fender washer 53. Lock nut 55 is screwed onto threaded rod 11 with its tapered side down and tightened to secure fender washer 53 and finish washer 54 in place. The number of colored beads 56 desired are placed on threaded rod 11; if the diameter of threaded rod 11 is smaller than that of the holes of colored beads 56, a short length of plastic electrical tape is wrapped around threaded rod 11 where the beads are to be placed so that they fit snugly on the taped part of threaded rod 11. Finish washer 57 is placed concave side down on threaded rod 11 above the last colored bead 56. Finish washer 57 is the uppermost holed component of lower portion 50; a nut of the upper portion of each chess piece secures colored beads 56 and finish washer 57 in place; preferably the bottom holed component of such upper portion is such a nut.

A preferred upper portion of a pawn comprises, more preferably consists of, a cap nut. Such cap nut is screwed onto the end of the machine screw center shaft component and tightened. The machine screw center shaft component is preferably of such length that when the cap nut is screwed on it and tightened, the lower surface of the cap nut rests tightly against the upper surface of the finish washer which is the uppermost component of the lower portion of the pawn, as described above.

Figure 14A:
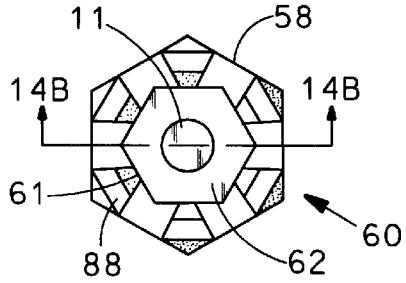
FIG. 14A is a top view and FIG. 14B is a cutaway side view of an upper portion of a preferred subject rook chess piece.
Figure 14B:
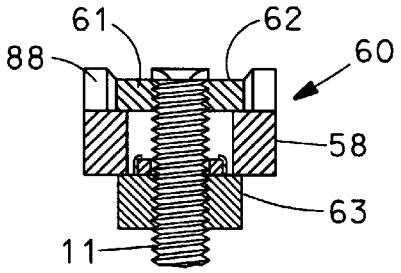

A preferred upper portion 60 of a rook is depicted in top view in FIG. 14A and cutaway side view in FIG. 14B. Upper portion 60 comprises lock nut 63 that is screwed tightly onto the machine screw center shaft component against the upper surface of the finish washer that is the uppermost holed component of the lower portion of the rook, as described above. Lock nut 63 is oriented with its tapered side up so that it is the lower support for slotted hex nut 58 that has a hole much larger in diameter than that of threaded rod 11. Standard nut 61 is nested in prongs 88 of slotted hex nut 58 (a little filing on slotted hex nut 58 is sometimes needed to achieve such nesting), and this two-nut unit is screwed onto threaded rod 11 and tightened such that the tapered side of lock nut 63 projects part way into the bottom of the hole in slotted hex nut 58 thus helping to secure it in place on threaded rod 11. The machine screw center shaft component is preferably of such length that, when assembly of the rook is complete, the end of threaded rod 11 is even with or slightly below upper surface 62 of standard nut 61.

Figure 15:
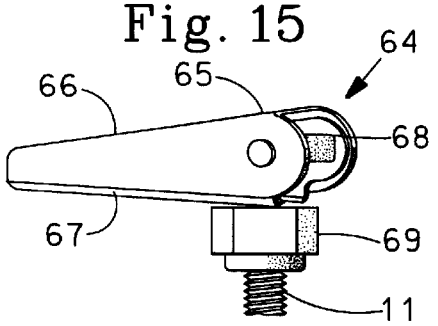
FIG. 15 is a side view of an upper portion of a preferred subject knight chess piece.

A preferred upper portion 64 of a knight is depicted in side view in FIG. 15. Upper portion 64 comprises lock nut 69 that secures the lower portion uppermost finish washer and colored beads in place, as described above. Lock nut 69 is preferably oriented with its tapered side down so that it projects partway into the hole of such finish washer. Toggle nut 65 is then screwed onto threaded rod 11 and tightened (a little filing of toggle nut 65 is sometimes needed in order to be able to screw it onto threaded rod 11). Threaded rod 11 is preferably of such length that when toggle nut 65 is screwed on tight, threaded rod 11 projects slightly above toggle nut 65 as depicted in FIG. 15, so that threaded rod 11 holds wings 66 and 67 in the closed orientation shown.

Figure 17:
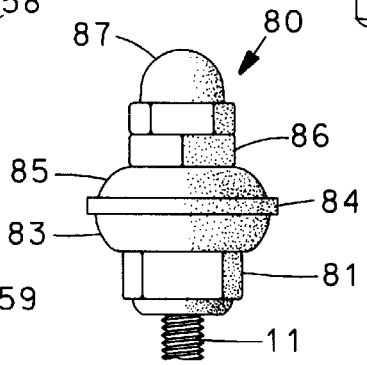
FIG. 17 is a side view of an upper portion of a preferred subject bishop chess piece.

A preferred upper portion 80 of a bishop is depicted in side view in FIG. 17. Upper portion 80 comprises lock nut 81 that secures the lower portion uppermost finish washer and colored beads in place, as described above. Lock nut 81 is preferably oriented with its tapered side down so that it projects partway into the hole of such finish washer. Above lock nut 81 on threaded rod 11 are placed two finish washers 83 and 85 that are the same size, with standard washer 84 having a diameter slightly greater than that of finish washers 83 and 85 between these finish washers, finish washers 83 and 85 being oriented with their concave sides against the two flat sides of standard washer 84. Next standard nut 86 is screwed onto threaded rod 11 and tightened so that washers 83, 84 and 85 are secured in place. Cap nut 87 is then screwed onto threaded rod 11 and tightened. The machine screw center shaft component is preferably of such length that when cap nut 87 is screwed onto it and tightened, the lower surface of cap nut 87 rests tightly against the upper surface of standard nut 86.

Figure 18:
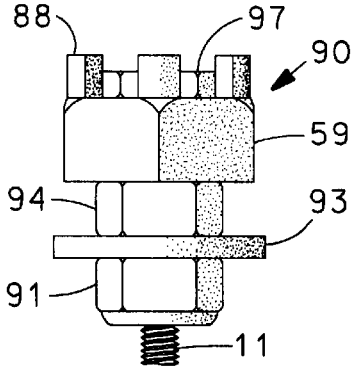
FIG. 18 is a side view of an upper portion of a preferred subject queen chess piece.
Figure 19:
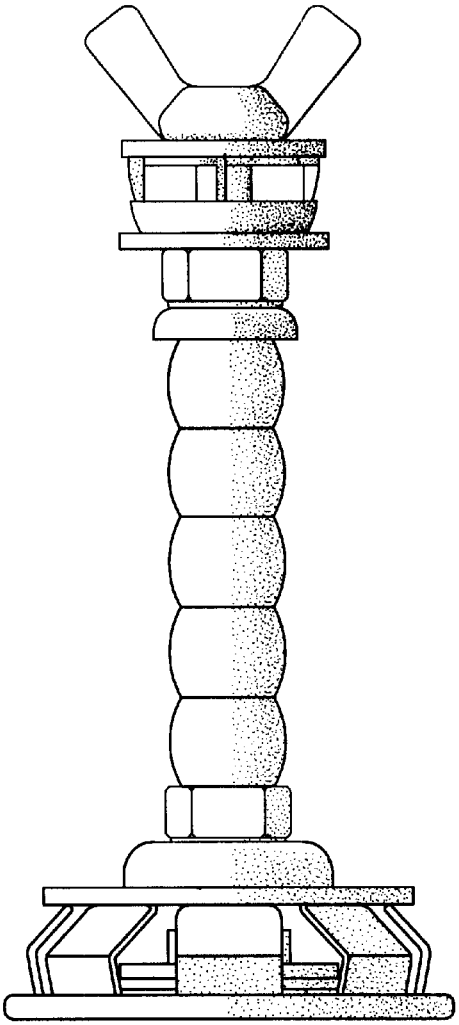
FIGS. 19, 20, 21, 22, 23 and 24 depict side views, about 1½ times enlarged, of the chess pieces of Examples 6, 5, 4, 2, 1 and 3, respectively.
Figure 20:
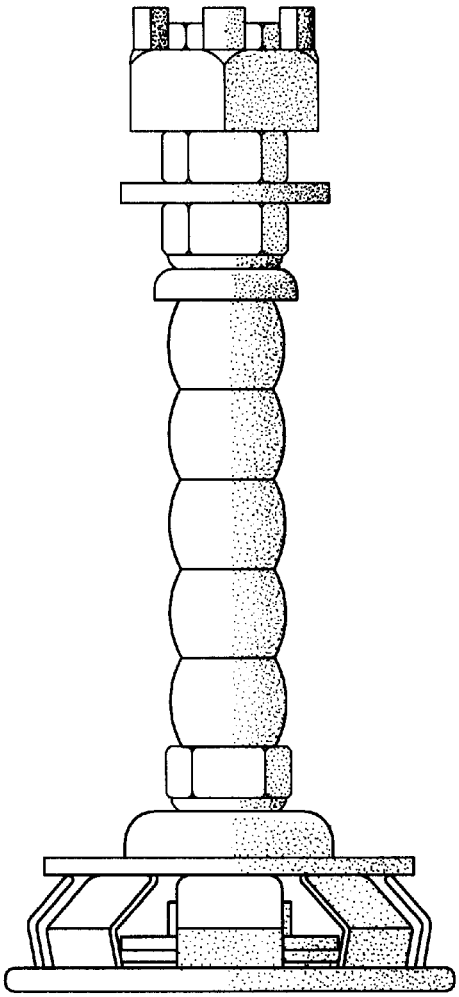
Figure 21:
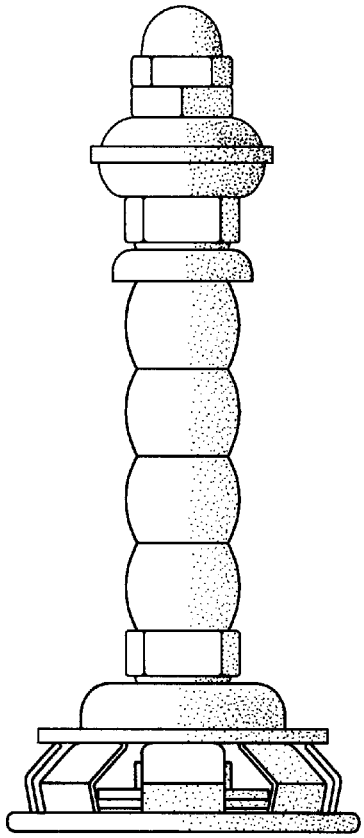
Figure 22:
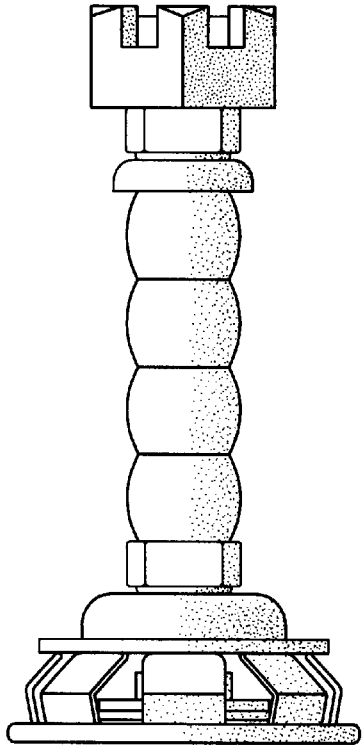
Figure 23:
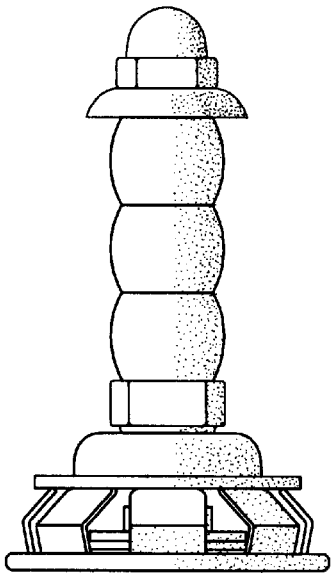
Figure 24:
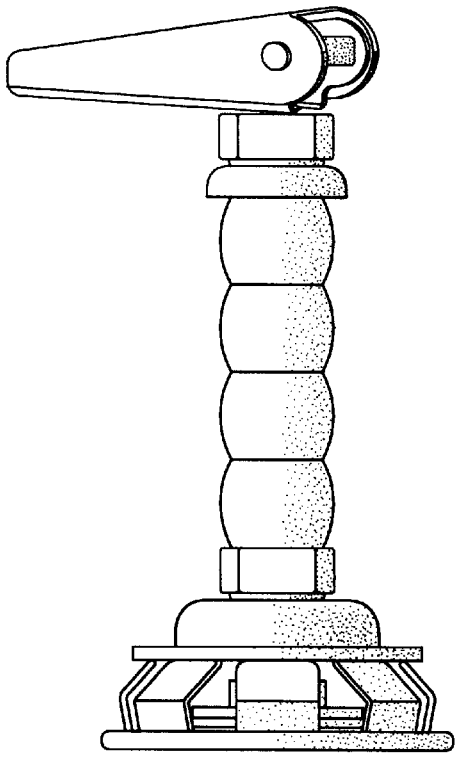

A preferred upper portion 90 of a queen is depicted in side view in FIG. 18. Upper portion 90 comprises lock nut 91 that secures the lower portion uppermost finish washer and colored beads in place, as described above. Lock nut 91 is preferably oriented with its tapered side down so that it projects partway into the hole of such finish washer. Next standard washer 93 is placed on threaded rod 11, and then lock nut 94 is screwed onto threaded rod 11 securing standard washer 93 in place on threaded rod 11. Lock nut 94 is oriented with its tapered side up, so that it serves as lower support for castle nut 59 that has a hole much larger in diameter than that of threaded rod 11. Castle nut 59 is of such size that standard nut 97 nests within prongs 89 of castle nut 59 (a little filing of castle nut 59 is sometimes needed to achieve such nesting). With standard nut 97 nested within prongs 89 of castle nut 59, this two-nut unit is screwed onto threaded rod 11 and tightened such that the tapered side of lock nut 94 projects part way into the hole of castle nut 59 from beneath it. The machine screw center shaft component is preferably of such length that when assembly of the queen is complete, the end of threaded rod 11 is even with or slightly below the upper surface of standard nut 97.

Figure 16:
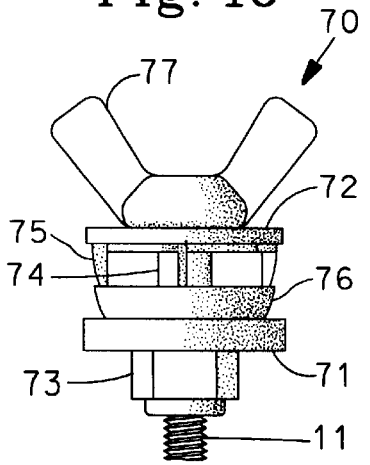
FIG. 16 is a side view of an upper portion of a preferred subject king chess piece.

A preferred upper portion 70 of a king is depicted in side view in FIG. 16. Upper portion 70 comprises lock nut 73 that secures the lower portion uppermost finish washer and colored beads in place, as described above. Lock nut 73 is oriented with its tapered side down so that it projects partway into the hole of such finish washer. Next standard washer 71, finish washer 76, T-nut 75, standard washer 72, and wing nut 77 are placed or screwed onto threaded rod 11 and tightened, in the orientations depicted in FIG. 16. The machine screw center shaft component is preferably of such length that when assembly of the king is complete, the end of threaded rod 11 is even with or slightly below the top of the threaded hole of wing nut 77.

EXAMPLES

The following examples provide a complete listing of all the components of each of the six different chess pieces described above, including the size for each component; each example begins with the center shaft component (machine screw) and then each holed component in the order that they are placed on or screwed onto the machine screw, i.e., from the bottom holed component to the top holed component. The orientations of the components are as described above for each of the six chess pieces.

Example 1

PAWN: 1½ inch (38 mm) 6-32 flathead machine screw, ½ inch knockout seal with a countersunk 3/16 inch hole drilled at its center, no. 10 standard washer, no. 6 standard washer, 6-32 standard nut, ⅛ inch×¾ inch fender washer, no. 8 finish washer, 6-32 lock nut, three 9 mm diameter×6 mm colored beads, no. 8 finish washer, 6-32 cap nut.

Example 2

ROOK: 2¼ inch (57 mm) 8-32 flathead machine screw, ¾ inch knockout seal with a countersunk ¼ inch hole drilled at its center, 7/32 inch standard washer, no. 8 standard washer, 8-32 standard nut, 3/16 inch×1 inch fender washer, no. 10 finish washer, 8-32 lock nut, four 9 mm diameter×6 mm colored beads, no. 8 finish washer, 8-32 lock nut, ⅜ inch slotted hex nut, 8-32 standard nut.

Example 3

KNIGHT: 2 3/16 inch (55 mm) 6-32 flathead machine screw, ¾ inch knockout seal with a countersunk 3/16 inch hole drilled at its center, no. 10 standard washer, no. 6 standard washer, 6-32 standard nut, 1/8 inch×1 inch fender washer, no. 10 finish washer, 6-32 lock nut, four 9 mm diameter×6 mm colored beads, no. 8 finish washer, 6-32 lock nut, 1/8 inch toggle nut.

Example 4

BISHOP: 2 3/8 inch (60 mm) 8-32 flathead machine screw, 3/4 inch knockout seal with a countersunk 1/4 inch hole drilled at its center, 7/32 inch standard washer, no. 8 standard washer, 8-32 standard nut, 3/16 inch×1 inch fender washer, no. 10 finish washer, 8-32 lock nut, four 9 mm diameter×6 mm colored beads, no. 8 finish washer, 8-32 lock nut, no. 8 finish washer, 7/32 standard washer, no. 8 finish washer, 8-32 standard nut, 8-32 cap nut.

Example 5

QUEEN: 2 11/16 inch (68 mm) 8-32 flathead machine screw, 1 inch knockout seal with a countersunk 1/4 inch hole drilled at its center, 7/32 inch standard washer, no. 8 standard washer, 8-32 standard nut, 3/16 inch×1 1/4 inch fender washer, no. 10 finish washer, 8-32 lock nut, five 9 mm diameter×6 mm colored beads, no. 8 finish washer, 8-32 lock nut, 1/4 inch standard washer, 8-32 lock nut, 3/8 inch castle nut, 8-32 standard nut.

Example 6

KING: 2 5/8 inch (66 mm) 8-32 flathead machine screw, 1 inch knockout seal with a countersunk 1/4 inch hole drilled at its center, 7/32 inch standard washer, no. 8 standard washer, 8-32 standard nut, 3/16 inch×1 1/4 inch fender washer, no. 10 finish washer, 8-32 lock nut, five 9 mm diameter×6 mm colored beads, no. 8 finish washer, 8-32 lock nut, 1/4 inch standard washer, no. 8 finish washer, 8-32 T-nut, 1/4 inch standard washer, 8-32 wing nut.

What is claimed is:

1. A chess piece having a base on which the chess piece rests when upright on a flat horizontal surface, a top which is the uppermost part of the chess piece when it is upright, and a height being the vertical distance from the base to the top; each chess piece comprising:

(a) a center shaft component having a bottom end and a top end and a length from its bottom end to its top end; the center shaft component comprising a vertical threaded rod having a bottom end, a top end, and a surface from the rod's bottom end to its top end that is partly or wholly cylindrical, the cylindrical surface being partly or wholly threaded; the center shaft component optionally comprising a head at either its bottom or its top end; and (b) holed components, each holed component having a hole through which or into which the center shaft component projects, the holed components being stacked along the length of the center shaft component, there being a bottom holed component and a top holed component and other holed components between the bottom and top holed components at the center shaft component, all the holed components being secured in place by one or more holed components which are nuts having threads complementary to those of the threaded rod, and optionally by the head of the center shaft component;

(c) one holed component being a knockout seal, the knockout seal comprising a disc having two circular surfaces, an outer rim of one surface, the outer rim defining a plane, prongs projecting from the other surface about perpendicular to the plane of the outer rim, the prongs having ends parallel to the disc surface from which they project, such ends of the prongs defining a plane parallel to the plane of the outer rim, and a hole through the disc from the center of one circular surface to the center of the other, the outer rim or the ends of the prongs of the knockout seal being the base of the chess piece.

2. The chess piece of claim 1 wherein the center shaft component is a bolt with a head at its bottom end and a rod with a cylindrical surface from the head to the top end of the rod, the cylindrical surface of the rod being partly or wholly threaded; the knock-out seal is the bottom holed component; and part or all of the head of the bolt is below the hole in the center of the disc of the knock-out seal.

3. The chess piece of claim 1 wherein one of the holed components is a slotted hex nut or a castle nut having an upper surface comprising prongs pointing upward, a lower surface, and a hole through its center, from the center of one surface to the center of the other surface, through which the center shaft component projects.

4. The chess piece of claim 3 wherein the size of the slotted hex nut or castle nut is such that a standard nut or a lock nut having threads complementary to those of the threaded rod is the top holed component and nests within the prongs of the slotted hex nut or castle nut; and wherein the slotted hex nut or castle nut is secured in place from above by such standard or lock nut nested within its prongs.

5. The chess piece of claim 1 wherein one of the holed components is a toggle nut having hinged wings and a threaded hole part with threads complementary to those of the threaded rod and through which the threaded rod projects, the hinged wings being held together in closed position by the threaded rod.

6. The chess piece of claim 1 wherein one holed component is a T-nut having a flat disc with two circular surfaces, a cylindrical shaft projecting from the center of one circular surface of the disc in a direction perpendicular to such disc surface to a circular end, the shaft having a length from the surface of the disc from which it projects to its circular end, a threaded hole through the center of the disc and the shaft, from the center of the other circular surface to the end of the shaft, and three or four sharp points projecting from near the outer edge of the same disc surface as the cylindrical shaft and pointing in a direction parallel to the shaft, each point having a sharp end away from such disc surface and a length from such disc surface to the sharp end, the length of all the points being equal and from about one-half to about three-fourths the length of the shaft; and another holed component is a finish washer having a circular convex surface, a circular concave surface, and a hole through which the shaft of the T-nut projects, the sharp ends of the points of the T-nut being in contact with parts of the concave surface of the finish washer.

7. The chess piece of claim 1 wherein the size of the knock-out seal is selected from the group consisting of one-half inch, three-quarter inch, and one inch; and the center shaft component is a machine screw of size and thread selected from the group consisting of 4-32, 6-32, 8-32, 10-32, and 10-24.

8. A chess piece having a base on which the chess piece rests when upright on a flat horizontal surface, a top which is the uppermost part of the chess piece when it is upright, and a height being the vertical distance from the base to the top; each chess piece comprising:

(a) a center shaft component having a bottom end and a top end and a length from its bottom end to its top end;

the center shaft component comprising a vertical threaded rod having a bottom end, a top end, and a surface from the rod's bottom end to its top end that is partly or wholly cylindrical, the cylindrical surface being partly or wholly threaded; the center shaft component optionally comprising a head at either its bottom or its top end; and (b) holed components, each holed component having a hole through which or into which the center shaft component projects, the holed components being stacked along the length of the center shaft component, there being a bottom holed component and a top holed component and other holed components between the bottom and top holed components at the center shaft component, all the holed components being secured in place by one or more holed components which are nuts having threads complementary to those of the threaded rod, and optionally by the head of the center shaft component;

(c) the base of the chess piece being regular geometric shape or circular having a diameter, and the ratio of the height of the chess piece to the diameter of the base being from about 2.5:1 to about 1.5:1.

9. A chess piece having a base on which the chess piece rests when upright on a flat horizontal surface, a top which is the uppermost part of the chess piece when it is upright, and a height being the vertical distance from the base to the top; each chess piece comprising:

(a) a center shaft component having a bottom end and a top end and a length from its bottom end to its top end; the center shaft component comprising a vertical threaded rod having a bottom end, a top end, and a surface from the rod's bottom end to its top end that is partly or wholly cylindrical, the cylindrical surface being partly or wholly threaded; the center shaft component optionally comprising a head at either its bottom or its top end; and (b) holed components, each holed component having a hole through which or into which the center shaft component projects, the holed components being stacked along the length of the center shaft component, there being a bottom holed component and a top holed component and other holed components between the bottom and top holed components at the center shaft component, all the holed components being secured in place by one or more holed components which are nuts having threads complementary to those of the threaded rod, and optionally by the head of the center shaft component;

(c) the center shaft component having a head at its bottom end, and the bottom holed component comprising a center part including the hole through which the center shaft component projects which is above at least part of the head of the center shaft component, and a part which is the base of the chess piece and is below the bottom of the head of the center shaft component;

(d) the base of the chess piece being regular geometric shape or circular having a diameter, and the ratio of the height of the chess piece to the diameter of the base being from about 2.5:1 to about 1.5:1.

10. The chess piece of claim 2 wherein the center shaft component is a machine screw with the cylindrical surface of its rod being wholly threaded, the disc of the knockout seal is indented, the outer rim of the knockout seal is the base of the chess piece, the hole in the disc of the knockout seal is above the plane of the outer rim, and the prongs of the knockout seal point upward, whereby the edges of the prongs parallel to the plane of the outer rim are the uppermost part of the knockout seal.

11. The chess piece of claim 10 wherein the ends of the prongs of the knockout seal define a circle; one holed component is a fender washer having an outer diameter, circular upper and lower surfaces, and a hole through its center, from the center of one surface to the center of the other, through which the center shaft projects, the outer diameter of the fender washer being larger than that of the circle defined by the ends of the prongs of the knockout seal, the fender washer being secured in place such that part of the lower surface of the fender washer is in contact with the ends of the prongs.

12. The chess piece of claim 11 comprising:

a. a machine screw center shaft component;

b. a lower portion comprising the knockout seal, the fender washer, and other holed components;

c. an upper portion comprising holed components, which identify the chess piece as a pawn, rook, knight, bishop, queen, or king.

13. The chess piece of claim 11 wherein one holed component is a finish washer having an outer diameter, a circular upper convex surface, a circular lower concave surface having an outer rim, and a hole through its center, from the center of one surface to the center of the other, through which the center shaft projects, the diameter of the outer rim of the finish washer being larger than that of the hole in the fender washer, the outer rim of the lower surface of the finish washer being in direct contact with part of the upper surface of the fender washer; the finish washer and fender washer being secured in place with a regular nut or a lock nut having an upper surface, a lower surface, a hole, from the center of one surface to the center of the other surface, through which the center shaft projects, and threads complementary to those of the machine screw, part of the lower surface of such nut being in direct contact with part of the upper surface of the finish washer.

14. The chess piece of claim 13 comprising:

a. a machine screw center shaft component;

b. a lower portion comprising the knockout seal, the fender washer, the finish washer, the nut in contact with the finish washer, and other holed components, wherein the lower portion also comprises craft beads as holed component having a team-identifying color;

c. an upper portion comprising holed components, which identify the chess piece as a pawn, rook, knight, bishop, queen, or king; all components of the chess piece, other than the craft beads, being hardware components.

15. The chess piece of claim 11 wherein the upper portion comprises holed component(s) selected from the group consisting of:

(a) a slotted hex nut or a castle nut having an upper surface comprising prongs pointing upward, a lower surface, and a hole through its center, from the center of one surface to the center of the other surface, through which the center shaft component projects, the size of the slotted hex nut or castle nut being such that a standard nut or a lock nut having threads complementary to those of the threaded rod nests within the prongs of the slotted hex nut or castle nut; and wherein the slotted hex nut or castle nut is secured in place from above by such standard or lock nut nested within its prongs, and from below by a lock nut having threads complementary to those of the threaded rod and a tapered upper surface part which is in direct contact with the lower surface of the slotted hex nut or castle nut;

(b) a toggle nut having hinged wings and a threaded hole part with threads complementary to those of the threaded rod and through which the threaded rod projects, the hinged wings being held together in closed position by the threaded rod;

(c) a T-nut having a flat disc with two circular surfaces, a cylindrical shaft projecting from the center of one circular surface of the disc in a direction perpendicular to such disc surface to a circular end, the shaft having a length from the surface of the disc from which it projects to its circular end, a threaded hole through the center of the disc and the shaft, from the center of the other circular surface to the end of the shaft, and three or four sharp points projecting from near the outer edge of the same disc surface as the cylindrical shaft and pointing in a direction parallel to the shaft, each point having a sharp end away from such disc surface and a length from such disc surface to the sharp end, the length of all the points being equal and from about one-half to about three-fourths the length of the shaft; and another holed component is a finish washer having a circular convex surface, a circular concave surface, and a hole through which the shaft of the T-nut projects, the sharp ends of the points of the T-nut being in contact with parts of the concave surface of the finish washer.

16. The chess piece of claim 11 wherein one holed component is a T-nut having a flat disc with two circular surfaces, a cylindrical shaft projecting from the center of one circular surface of the disc in a direction perpendicular to such disc surface to a circular end, the shaft having a length from the surface of the disc from which it projects to its circular end, a threaded hole through the center of the disc and the shaft, from the center of the other circular surface to the end of the shaft, and three or four sharp points projecting from near the outer edge of the same disc surface as the cylindrical shaft and pointing in a direction parallel to the shaft, each point having a sharp end away from such disc surface and a length from such disc surface to the sharp end, the length of all the points being equal and from about one-half to about three-fourths the length of the shaft; and another holed component is a finish washer having a circular convex surface, a circular concave surface, and a hole through which the shaft of the T-nut projects, the sharp ends of the points of the T-nut being in contact with parts of the concave surface of the finish washer.

17. The chess piece of claim 12 wherein the lower portion also comprises one type of holed component having a team-identifying color; all components of the chess piece, optionally other than the type of holed component having a team-identifying color, being hardware components.

18. The chess piece of claim 17 wherein the holed component having a team-identifying color is one or more craft beads of one color, the beads having a hole through which the rod of the machine screw projects, the beads being the only component having such team-identifying color.

19. The chess piece of claim 17 wherein one of the holed components of the upper portion is a slotted hex nut or a castle nut having an upper surface comprising prongs pointing upward, a lower surface, and a hole through its center, from the center of one surface to the center of the other surface, through which the center shaft component projects, the size of the slotted hex nut or castle nut being such that a standard nut or a lock nut having threads complementary to those of the threaded rod nests within the prongs of the slotted hex nut or castle nut; and wherein the slotted hex nut or castle nut is secured in place from above by such standard or lock nut nested within its prongs, and from below by a lock nut having threads complementary to those of the threaded rod and a tapered upper surface part which is in direct contact with the lower surface of the slotted hex nut or castle nut.

20. The chess piece of claim 17 wherein one of the holed components is a toggle nut having hinged wings and a threaded hole part with threads complementary to those of the threaded rod and through which the threaded rod projects, the hinged wings being held together in closed position by the threaded rod.

21. The chess piece of claim 17 wherein the top holed component is a cap nut having a hole, with threads complementary to those of the threaded rod, into which the threaded rod projects.

22. The chess piece of claim 17 wherein the top holed component is a wing nut having a hole, with threads complementary to those of the threaded rod, through or into which the threaded rod projects.

23. A chess set comprising two teams of chess pieces of claim 17, each team comprising eight pawns, two rooks, two knights, two bishops, one queen, and one king.

24. The chess piece of claim 9 wherein the upper portion comprises holed component(s) selected from the group consisting of:

(a) a slotted hex nut or a castle nut having an upper surface comprising prongs pointing upward, a lower surface, and a hole through its center, from the center of one surface to the center of the other surface, through which the center shaft component projects, the size of the slotted hex nut or castle nut being such that a standard nut or a lock nut having threads complementary to those of the threaded rod nests within the prongs of the slotted hex nut or castle nut; and wherein the slotted hex nut or castle nut is secured in place from above by such standard or lock nut nested within its prongs, and from below by a lock nut having threads complementary to those of the threaded rod and a tapered upper surface part which is in direct contact with the lower surface of the slotted hex nut or castle nut;

(b) a toggle nut having hinged wings and a threaded hole part with threads complementary to those of the threaded rod and through which the threaded rod projects, the hinged wings being held together in closed position by the threaded rod;

(c) a T-nut having a flat disc with two circular surfaces, a cylindrical shaft projecting from the center of one circular surface of the disc in a direction perpendicular to such disc surface to a circular end, the shaft having a length from the surface of the disc from which it projects to its circular end, a threaded hole through the center of the disc and the shaft, from the center of the other circular surface to the end of the shaft, and three or four sharp points projecting from near the outer edge of the same disc surface as the cylindrical shaft and pointing in a direction parallel to the shaft, each point having a sharp end away from such disc surface and a length from such disc surface to the sharp end, the length of all the points being equal and from about one-half to about three-fourths the length of the shaft; and another holed component is a finish washer having a circular convex surface, a circular concave surface, and a hole through which the shaft of the T-nut projects, the sharp ends of the points of the T-nut being in contact with parts of the concave surface of the finish washer.

25. The chess piece of claim 18 wherein the size of the knockout seal is selected from the group consisting of one-half inch, three-quarter inch, and one inch; and the size of the machine screw and thread is 6-32 or 8-32.

26. A chess set comprising two teams of chess pieces of claim 25, each team comprising eight pawns, two rooks, two knights, two bishops, one queen, and one king, the beads of the chess pieces of each team being the same color and a different color from the beads of the chess pieces of the other team.

* * * * *